United States Patent [19]

Sarofeen et al.

[11] Patent Number: 4,534,137

[45] Date of Patent: Aug. 13, 1985

[54] METHOD FOR PATTERN GENERATION AND SURFACING OF OPTICAL ELEMENTS

[76] Inventors: George M. J. Sarofeen, 12501 Brook La., Chester, Va. 23831; Jeffrey T. Perkins, 1300 Old Long Trail, Richmond, Va. 23235

[21] Appl. No.: 455,201

[22] Filed: Jan. 3, 1983

Related U.S. Application Data

[63] Continuation-in-part of Ser. No. 404,124, Aug. 2, 1982, abandoned.

[51] Int. Cl.[3] ..... B24B 1/00

[52] U.S. Cl. ..... 51/284 R; 51/57

[58] Field of Search ..... 51/57, 58, 160, 284 R, 51/55, 60, 67, 119, 162

[56] References Cited

U.S. PATENT DOCUMENTS

| | | | |
|---|---|---|---|
| 2,159,620 | 5/1939 | Long | 51/160 |
| 2,168,843 | 8/1939 | Lockhart | 51/160 |
| 2,754,638 | 7/1956 | Duffens | 51/160 |
| 3,156,073 | 11/1964 | Strasbaugh | 51/57 |
| 3,552,899 | 1/1976 | Tagnon | 51/160 |

*Primary Examiner*—Harold D. Whitehead

*Attorney, Agent, or Firm*—George M. J. Sarofeen

[57] ABSTRACT

A method for generating patterns progressively changing in configuration from circular through eliptical and oval and inclusive of rectilinear traces is effected by constraining a stylus to movement along mutually othogonal axes, by generating plural sets of stylus displacement forces and by applying such forces in combination to the stylus. The stylus displacement force sets vary with time in respective magnitudes and senses to compel stylus movement progressively in such circular, eliptical, oval and rectilinear patterns. In use of the pattern generating method for surfacing of an optical element, a surfacing tool in engagement with the optical element is displaced as the stylus and the optical element may itself be subjected to oscillatory movement.

27 Claims, 8 Drawing Figures

| | U | L |
|---|---|---|
| P-1 | 1 | 1 |
| P-2 | 1 | 2 |
| P-3 | 2 | 4 |
| P-4 | 1 | 4 |
| P-5 | 1 | 5 |
| P-6 | 2 | 7 |
| P-7 | 1 | 7 |
| P-8 | 1 | 1 |

METHOD FOR PATTERN GENERATION AND SURFACING OF OPTICAL ELEMENTS

CROSS-REFERENCE TO RELATED APPLICATIONS

This application is a continuation-in-part of pending U.S. patent application Ser. No. 06/404,124, filed on Aug. 2, 1982 and entitled "Pattern Generator and Drive Apparatus" now abandoned.

FIELD OF THE INVENTION

This invention relates generally to pattern generation and pertains particularly to the surfacing of optical lenses by grinding and polishing same in accordance with generated patterns.

BACKGROUND AND SUMMARY OF THE INVENTION

Grinding and polishing operations are carried out in the conduct of various commercial, industrial and scientific pursuits. Some machinery for performing such operations is spherically tooled for lapping and polishing spherical surfaces. In some cases, the lapping tool is driven while in other cases the workpiece is driven against a stationary lap. In connection with such operations, while spinning the workpiece or lap, a randomizing of the grinding and polishing action is provided in order to distribute wear evenly over the whole surface of the workpiece. This has been accomplished in the past through causing the workpiece or the lap to be orbited or oscillated with respect to the spin axis of the tool. Such an action is called a "Breakup", especially when the extremities of the motion produced lie at different points. This functions to deter the creation of aberrations especially in optical flats, spherical or toric surfaces.

Surfacers of the high speed type to which this invention may be applied, have only recently been brought into broad usage within the ophthalmic lens trade. A good example of such surfacers are manufactured and sold as models numbered 504, 505, 506, etc. by Coburn Manufacturing of Muskogee, Okla. The 504, etc. series of machines was developed in answer to the challenge of severe limitations in the speed capabilities of the formerly available surfacing equipment, particularly those limitations in the performance characteristics of toric polishers which are also known as cylinder machines.

The earlier equipment incorporated various mechanisms for producing single axis oscillatory stroking action for surfacing a lens. Such machines had some features in common, characterized by the use of a work holder adapted to hold a lens rigidly in place while it was being surfaced. The driving mechanism was applied to driving the surfacing lap in relation to the surface of a fixed lens. A constantly changing randomized path of travel was produced while maintaining an axis of the lap firmly and constantly in parallelism with an axis of the lens. The net resulting motion was the product and combination of oscillatory drives directed along single axes arranged at ninety degrees from each other. The evolutionary improvements in such apparatus consisted principally in adding speed of drive to the single axis oscillatory motions. These increases in speed were found to produce heightened vibration and caused excessive wear and tear on the linkage. This equipment was subject to practical limitations by reason of the excessive vibration which developed as one increased the speeds at which such mechanical structures were attempted to be driven.

The economic conditions of competition in the lens making industry, with the attendant increases in labor cost, demanded that machines be produced having greater speed of relative lens and lap movement needed to improve surfacing capability. It became evident that some new and unique means for producing greater relative motion between lens and lap, per unit of time, was needed. This requirement posed severe problems. Accelerated relative motion of the oscillatory type in such equipment had to be provided with the axis of the lens curves always maintained in parallelism with an axis of the surfacing tool and lens curves. The speed limitations were first measurably overcome by advent of the Coburn 504, etc. series of machinery. In this construction, the surfacing tool was driven orbitally in a rotary motion with the surfacing tool maintained in constant axis alignment with an axis of the lens. A gimbal arrangement was utilized, through which a shaft extended and on which the surfacing tool was supported. The gimbal was fixed in a block which was journaled to allow rotation in the gimbal on pivots set ninety degrees apart for universal lateral movement, while being held fixed against rotational movement. Connected at the lower end of the tool supported shaft, was an eccentric drive unit which was arranged to drive the lower end of the support shaft orbitally. The motion of the tool at the upper end of the support shaft in the gimbal thus tracked exactly opposite to the drive action at the lower end of the shaft. In this way the tool on the upper end of the support shaft was driven in a circular orbit while the shaft remained fixed against axial motion. By this drive means a significant and meaningful improvement in speed of surfacing was achieved.

This equipment, while being an advance over prior designs, suffers from a high rate of mechanical attrition due to excessive wear. The wear thus occasioned within a short time affects the quality of lenses produced and the speed of surfacing.

The principal advantage of this 504, etc. series machinery is in the increased speed of surfacing achieved by driving the tool shaft orbitally. This series of machinery thus driven received immediate acceptance by the trade and at the present time is the mainstay of the industry in ophthalmic optical prescription processing. The machines are used in spite of their serious shortcoming of excessive early wear and the fact that they require repeated rebuilding to keep them servicable.

This advent and acceptance of the Coburn 504, etc. series equipment in spite of their shortcomings has firmly established the use of such machines having orbitally driven tool holders in the trade.

Another example of a surfacing machine having an orbitally driven tool is one manufactured by Howard Strasbaugh Company of Van Nuys, Calif.

Both the Coburn and Strasbaugh surfacers are provided with a break-up motion which causes the tool holder to be orbited on a first circular orbit about a first center of rotation which center is then eccentrically rotationally displaced on a second center of rotation in a second orbit to attempt to minimize the effects of excessive retracking which could result in making aberrations in the surface of the lens.

The above prior art equipment is adaptable to surfacing of lenses having spherical as well as cylindrical surfaces, but is used predominantly in the surfacing of lenses having cylindrical surfaces. Their principal contribution to state of the art has been to increase cylindrical surface polishing speed capability.

As is detailed below, the method and apparatus of the present invention provides an improved system for polishing such lenses over the above prior art machines described by driving the lens orbitally but in constantly changing patterns not limited to simply rotary movements. The patterns generated by the method of the present invention do not constantly retrack circular paths as in the above described Coburn and Strasbaugh types. The motions produced in equipment of the present invention range from essentially straight line action tracking along the path of one axis of the lens and then the other, and in between travel along the axes transitioning through elliptical, modified elliptical and then a limited number of circular orbits in constantly changing patterns. The need for a second centered orbital drive for purpose of providing a break-up is thus eliminated.

Cylindrical (toric) ophthalmic lenses of the trade comprise variable powers of magnification or minification which differ in range in optical power gradually between the two dominant radii of curvature placed ninety degrees apart the radii of the base and cross curves. Such lenses are used to neutralize astigmatism in a patient's vision.

In practice, such a lens when it is to be surfaced is "blocked" or mounted so that it becomes attached to a holder. The holder is provided with at least a pair of recessed conical detents lying along a line in the surface opposite to the surface where the lens is attached. Care is taken in blocking the lens to reference the intended axis of one of the dominant curves so that it lies in the plane of the line passing through the center point of the conical detents. These center points then become the referencing points to which lens or curve axes are registered or indexed in processing the lens through successive steps toward completion. The dominant curves which lie ninety degrees apart are called "base curve" and "cross curve" with all interlying curves taken on any given axis therebetween called intermediate curves. The lens when completed and gaged optically is stated to have a base curve power and a cross curve power separated arcuately by the aforesaid ninety degree spacing.

The lens and holder are first placed within a curve generator which can be set to cut a wide range of combinations of base and cross curves on the surface of the lens to be worked. The desired curves are then pre-set into the controls of the curve generator in accordance with the desired cylindrical prescription to be prepared. The lens is then diamond ground in the generator, excess stock is removed, and the desired curve combination is established.

When leaving the generator both curves have been established to approximate trueness and a rather rough lens surface having approximately the radii of curvatures is provided. This surface must then be fine ground, i.e, "fined", and then polished.

The remaining steps in completing the lens to the desired optical characteristics are performed on the surfacing apparatus of the prior art type first above described and according to the description of the improved method and apparatus of the present invention which ensues.

The first such additional step is the fining process. In this step, using the Coburn 504, etc. type equipment, a lapping tool which has been previously formed to the desired combination of toric curves is mounted on the driven tool holder and the lens positioned in contact therewith. A pair of pointed guide pins which are supported on an arm arranged to oscillate along the axis of the base curve are placed in the conical detents of the lens block under pressure. These then move the lens and block back and forth over the orbiting tool on a fixed axis line. The oscillating arm rocks allowing the lens to tilt in the direction of the dominant axis of the lens in order to maintain contact with the lap while the tool is orbiting. This oscillating is done to establish an additional randomizing motion which combines with the eccentrically rotating axis of the orbiting lower tool to provide further "break up" motion.

The inventors of the present invention recognized that the prior art Coburn 504, etc. type orbitally driven apparatus, while adequate, needed to be improved upon to eliminate shortcomings of that equipment which result from simple orbital movement. These improvements take into account the fact that different motions and physical structures were needed. The cylinder (toric) lens surface as stated previously is comprised of two dominant curves on separate axes with myriad intervening curves. This produces an unusual surface on which the high spots must be removed quickly and the surface matched and reached to mate intimately in every part uniformly by the lap as soon as possible in order to surface the lens in a minimum of time to a maximum of truth in the optics produced.

It was postulated by the inventors that an improvement on the motions produced by the prior art apparatus was needed to speed and improve the lens polishing process. It was further postulated that producing a lapping drive motion which would cause tracking of the lap motion for a part of the surfacing cycle which would extend substantially along the axis of each of the base curves would produce better truth in optics. Also that maximum randomization could be reached by causing the motions to occur in a constantly changing elliptical, modified elliptical, and circular motion when transitioning from the essentially straight line motion tracking along the base curve line axis to the essentially straight line motion along the cross curve axis. It was also considered that speed of the polishing would thus be enhanced.

Accordingly, it is an object of the present invention to provide a randomized orbitally driven lens surfacing method comprising a drive motion which at times traverses the lens surface in substantially linear tracks along the axis of the base and the cross curve, and moves when transitioning therebetween through generally elliptically-orbital and circular motions in a constantly shifting variety of patterns.

It is a further object of this invention to provide method for producing multi-form surfacing patterns according to the method of the present invention.

It is a further object of the present invention to improve generally upon methods for surfacing toric and spherical lenses.

In practice under the invention, patterns are provided of progressively changing configuration. A stylus is constrained to move along mutually perpendicular axes. Sets of displacement forces are generated and applied to the stylus. The sets of such forces vary with time in magnitudes and senses to compel stylus movement in such progressively changing patterns.

Preferred apparatus for implementing this practice includes a pair of links having first ends pivotally connected to a stylus plate. A separate locus for movement of each of the opposite link ends is defined, by pivotally connecting such ends to separate wheels at off-center positions thereof. As the wheels rotate, each generates a set of displacement forces which is applied to the link connected thereto. With the links each at the same radial spacing on their wheels and with the links in phase, e.g., both at the nine o'clock positions, revolution of the wheels will displace a stylus on the stylus plate in a circular pattern. As the wheels are progressively misphased, the apparatus generates differing set of displacement forces, giving rise to displacement of the stylus in the above-noted progressively changing patterns.

In accordance with the method of the invention, realized in one specific practice by the above described apparatus, one selects and stores first and second sets of positional coordinates, each set having a corresponding number of elements. A pattern generator, e.g., stylus, is supported for movement along first and second different axes and is displaced selectively in accordance with the positional coordinate sets.

In the specific realization of the method in the above described apparatus, the positional coordinate sets are respectively in the two circular loci of the wheels. If one looks to sets of eight in number, the coordinates are those found at the eight (forty-five degree) spaced locations in each circular locus. As the wheels rotate into forty-five degree phase difference, the first set values are combined with the forty-five degree lagging second set values. Thus, combinations are made of the first element in the leading set with the eighth element in the lagging set, the second element in the leading set with the first element in the lagging set, etc., as rotation ocurs at such forty-five degree angle. The phase difference is preferably increased at a very slow rate, whereby many revolutions may occur before the wheels return to an in-phase condition and pattern change may be effected quite gradually. The out-of-phase relation may be effected providing identical circular loci and rotating the wheels at different speeds or by providing respectively different loci and rotating the wheels at the same speed.

The foregoing and other objects and features of the method and apparatus of the invention will be further understood from the following detailed description of preferred embodiments thereof and from the drawings wherein like reference numerals and literals identify like parts throughout.

DESCRIPTION OF PREFERRED PRACTICES AND APPARATUS

Figure 1:
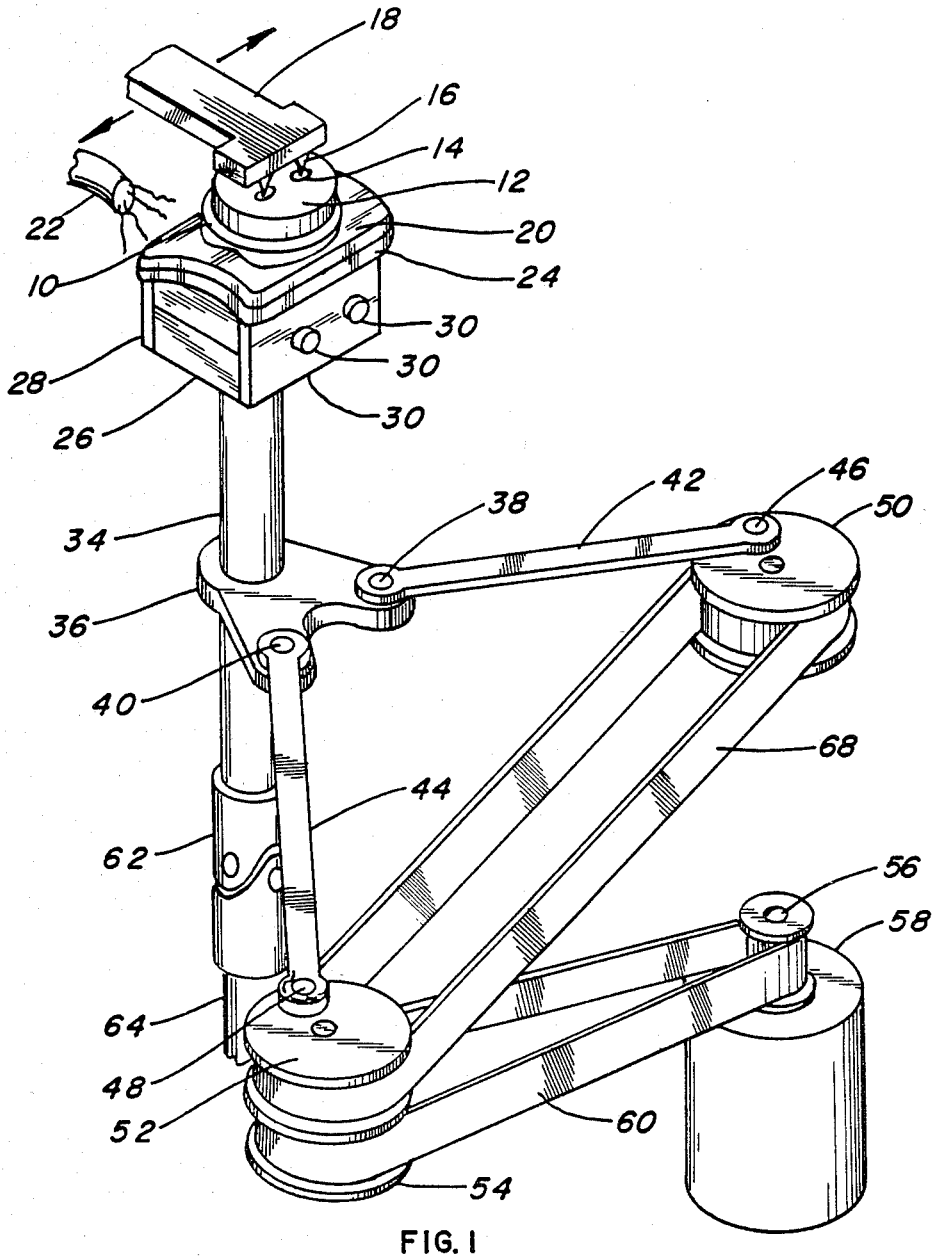
FIG. 1 is a view in perspective illustrating drive linkage arranged according to the present invention.

Now referring in particular to FIG. 1, an oscillatory arm 18 is equipped with a pair of alignment pins 16. The arm 18 is adapted to be pressed downwardly to exert pressure, by apparatus, not shown, on the pins 16 driving them downwardly into conical detents 14 in lens block 12. A lens 10 which is adhesively secured to lens block 12 is therby brought under the downwardly urging influence of the oscillatory arm 18 and is held in axial alignment against rotational movement by the pins 14. In operation the oscillatory arm 18 is actuated by conventional apparatus, not shown, to provide limited oscillatory movement along the axis of the base curve to combine with the sum of movements and patterns of movement imparted to the lapping tool 26 to result in randomizing motions as desired for the lapping function.

The lap holder 26 is equipped with a back clamp member 28 and front clamp member 30 which therebetween rigidly attach the abrading or polishing lap 24 to the lap holder 26. An abrading or polishing pad 20 is interposed over the surface of the lap 24 and under the surface of the lens 10. A slurry nozzle 22 discharges a slurry of either abrading or polishing material 23 onto the lens 10 and pad 20 and, on relative motion between the lap 24 and lens 10, the slurry 23 is rubbed against the surface of the lens 10 to grind or polish that surface of the lens while in contact with the pad 20.

Figure 2:
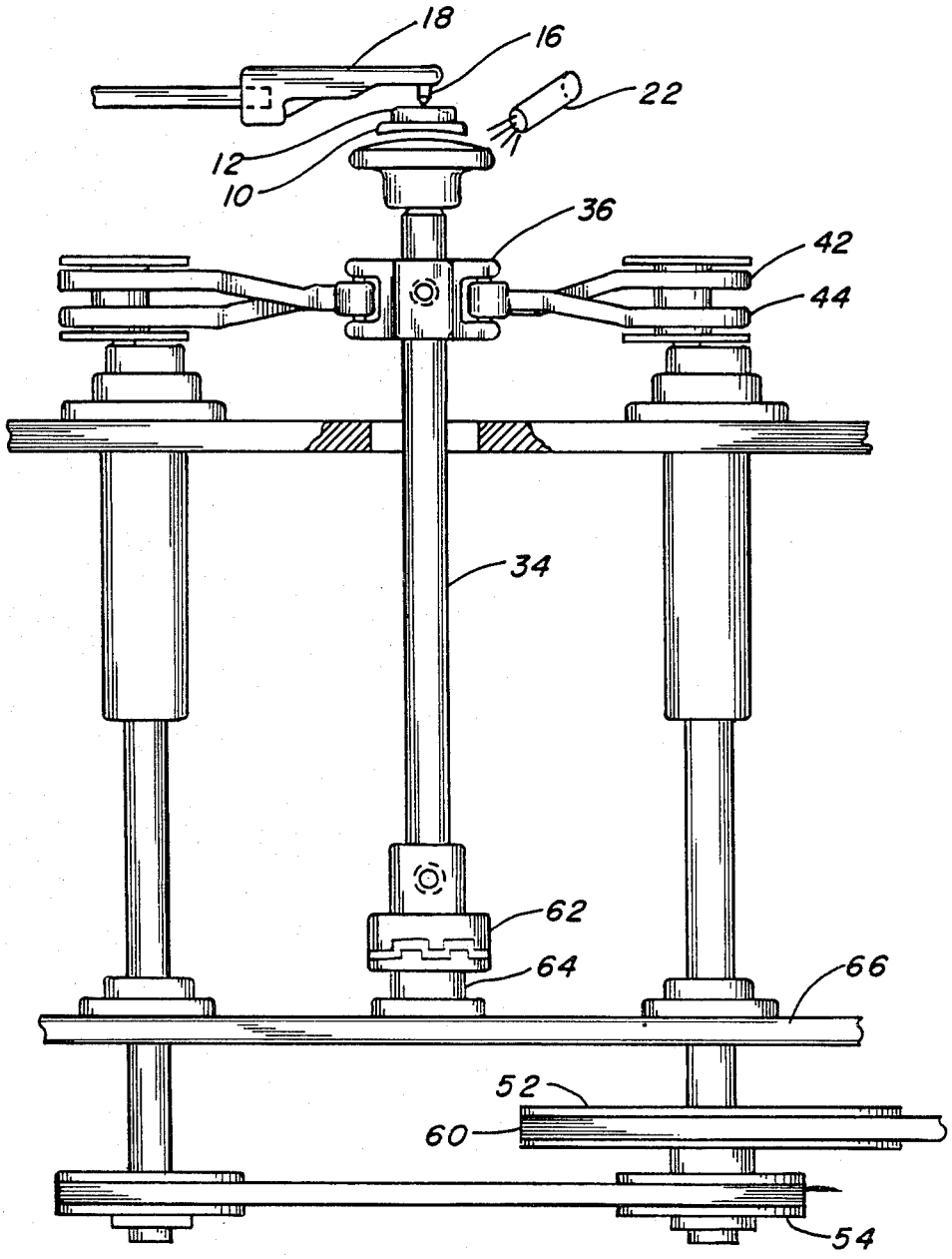
FIG. 2 is a view in elevation of another form of similar linkage to that in FIG. 1.

The lap holder support shaft (stylus) 34 is rigidly fixed by suitable means to the lower portion of the lap holder 26. The support shaft 34 subtends from the lap holder to universal joint 62 where it is attached by suitable means to the movable upper end of the universal joint 62. Rotative motion of shaft 34 relative to orthogonal axes, namely, the pins of universal joint 62, is thus enabled. The lower end of the universal joint 62 is rigidly mounted on support shaft mount 64 by suitable means and, in turn, the mount 64 is suitably affixed rigidly to a shaft mount plate 66 as shown in FIG. 2.

A support shaft drive yoke (stylus plate) 36 is affixed to the drive shaft 34 at a point between the lap holder 26 and the universal joint 62. An upper yoke drive pin 38 connects for pivotal movement to one end of an upper yoke drive link 42. The opposite end of the upper yoke drive link 42 is connected for pivotal movement through an upper yoke drive pin 46 which is positioned eccentrically on an upper drive pulley 50. A lower yoke drive pin 40 connects for pivotal movement to one end of a lower yoke drive link 44. The opposite end of the lower yoke drive link 44 is connected for pivotal movement through a lower yoke drive pin 48 which is positioned eccentrically on a lower drive pulley 52. Pulleys 50 and 52 are suitably journaled on rigidly supported shafts by conventional means for rotational movement. A positive drive belt 68 interconnects pulleys 50 and 52 for coordinated rotation. A motor driven pulley 54 is fixed to pulley 52 so that both turn at the same speed. The diameters of pulleys 50 and 52 are made slightly different in size. The motor 58 when energized turns pulley 56 which then drives the above described apparatus through motor drive belt 60 which rotates pulley 54 to energize the linkage which then functions to drive the lap 24 in a unique pattern as will best be described when taken in connection with FIG. 4.

Figure 4:
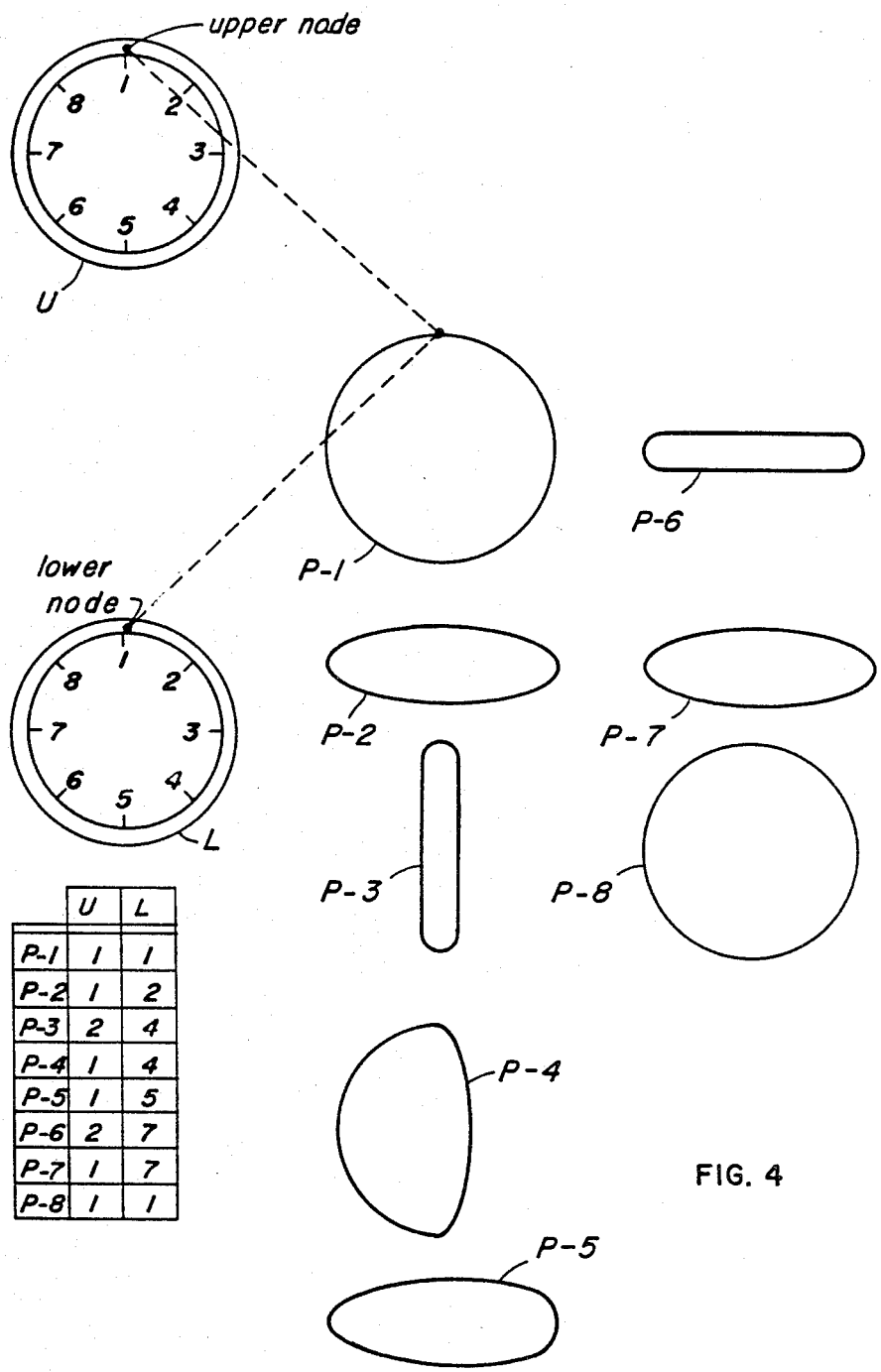
FIG. 4 is a group of diagrams showing patterns generated by drive linkage according to one form of the present invention.

In FIG. 4, there are represented the equivalent of two discs each bearing reference numbers from 1 through 8 about their peripheries. The disc marked capital "U" represents the upper eccentric drive pulley 50 and the disc marked capital "L" represents the lower eccentric drive pulley 52. At the number 1 position on each disc is placed a node legend, the node legend on the upper disc being "upper node" and the node legend on the lower disc being "lower node". The nodes represent a chosen beginning relative positioning of the upper and lower drive pins 46 and 48 on eccentric drive pulleys 50 and 52.

To understand the following explanation of how the method and apparatus of the present invention function it must be borne in mind that, as described above, the upper and lower eccentric drive pulleys 50 and 52 are made of diameters of different size, and since they are interconnected to be driven by positive drive belt 68 they will each rotate at different numbers of revolutions per minute for a given distance of lineal feet per minute travelled by the drive belt 68. This in effect means that for any given number of revolutions per minute of the motor drive shaft pulley 56, the upper and lower eccentric drive pulleys 50 and 52 will turn at different rotational speeds to cause the upper and lower nodes of FIG. 4 to change relative arcuate position constantly with respect to a node disc center line drawn through the upper and lower node positions, when at position No. 1, the and centers of the upper and lower node discs as appearing in FIG. 4.

For instance, if, for illustration, the upper concentric drive pulley 50 were to be made of a smaller diameter than the lower concentric drive pulley 52, then the upper drive pulley 50 will turn at a faster rate of speed which will result in the upper disc node, after a single revolution, reaching the upper No. 1 position on the upper disc prior to the lower node reaching the top number 1 position on the lower disc, according to the illustration as set out in FIG. 4.

With this out-of-phase relationship established, where one node lags the other on rotation, it can be seen that the node on the larger eccentric drive pulley, upper or lower as the case may be, will lag behind by a given amount per revolution of the smaller pulley. As a result of this action, and depending on the direction of drive, i.e., clockwise or counterclockwise, the node of the larger pulley will lie progressively, arcuately at a position of different number at a higher or lower digital value of from 1 through 8 each time the node position of the smaller pulley crosses the center line of FIG. 4 at positions numbered 1.

The net effect of this progressive shifting of phase of the nodal points is to position the drive point of shaft 34, for any given instant in time, to a particularly referenced position based on the combination of arcuate distance of each of the nodes from, for instance, the number 1 positions as shown in FIG. 4. To better convey and understanding of the kaleidoscopic and myriad orbital and straight line patterns which are generated in each of the cycled sequences, i.e., when the upper and lower nodal points, for instance, return to a point taken to be the beginning of any single sequence, reference is made to FIG. 4 of the drawings and following text below. Following the completion of a given sequence, a new sequence is immediately begun and follows its course until once again the beginning point is overtaken and a subsequent repetitive sequence is begun.

Some of the patterns are substantially as shown in the series of patterns outlined in FIG. 4. These are marked P-1 through P-8. The table T-1 in FIG. 4 shows the approximate locations of the nodal point positions during each single turn of the drive point 70 when it may trace one of the patterns as shown in P-1 through P-8 of said FIG. 4.

The pattern in P-1 is generated in a single turn of both discs in which the upper and lower nodes are both at or adjacent the number 1 positions of both discs U and L, which as stated represent the nodal point position references on the concentric drive pulleys.

The pattern in P-2, for instance, is generated in a single turn of both discs during which the upper nodal point is at position 1 and lower nodal point is at position 2.

It follows therefore that by entering Table T-1, one can predetermine the approximate relative positions of the upper and lower nodal points during generation of any of the patterns shown from P-1 through P-8 in FIG. 4 for any single revolution of both discs.

It will be understood that the actual patterns created during high speed operation may not be purely as shown herein. The actual motions produced may vary slightly from those shown since they are constantly changing due to the constant shifting of phase between the upper and lower nodal points. This constant shifting of the patterns traced results in a highly desirable thorough randomizing of motion for each sequence of motions in the driving of the lap holder support shaft.

A further advantage of the apparatus of the present invention is that a very large variety of patterns are thus provided with a very minimum of mechanism employed. This thorough randomizing of motion when further combined with the oscillatory movement of the lens 10, provided by the oscillating arm 18, results in rapid abrading and polishing performance over the entire surface of the work-piece. A surprising and unexpected feature is the high speed attained in completing the abrading and polishing cycles. A lens is abraded or polished in a significantly shorter time by the method of the present invention when compared to methods and machines of the prior art.

Figure 3:
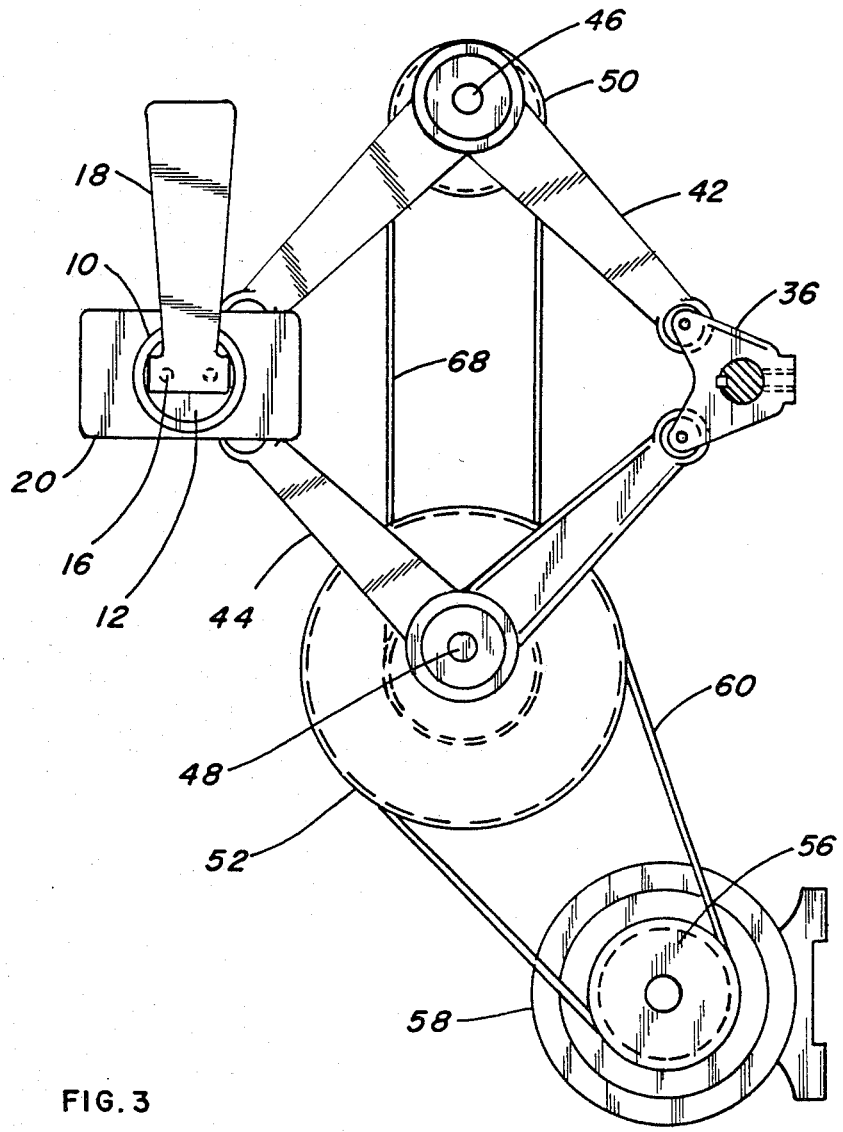
FIG. 3 is a top plan view of the linkage of FIG. 2.

FIGS. 2 and 3 illustrate a form of formally designed apparatus made in accordance with the present invention showing how a pair of polishing stations may be arranged to be driven from a single drive source. Suitable linkage may be used to drive many work stations from a single pair of eccentric drives.

Figure 5:
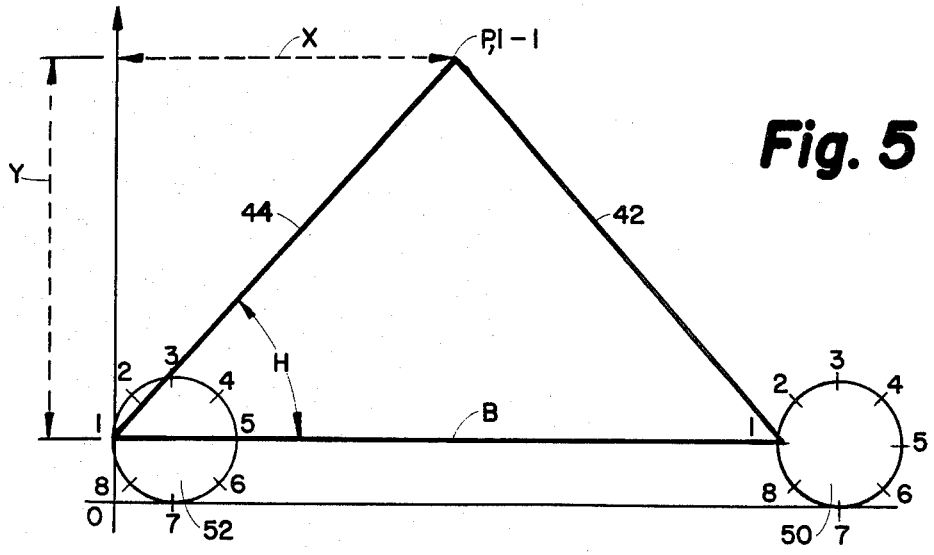
FIGS. 5, 6 and 7 are explanatory diagrams from which the geometric activities of the mechanism of FIG. 1 may be understood.
Figure 6:
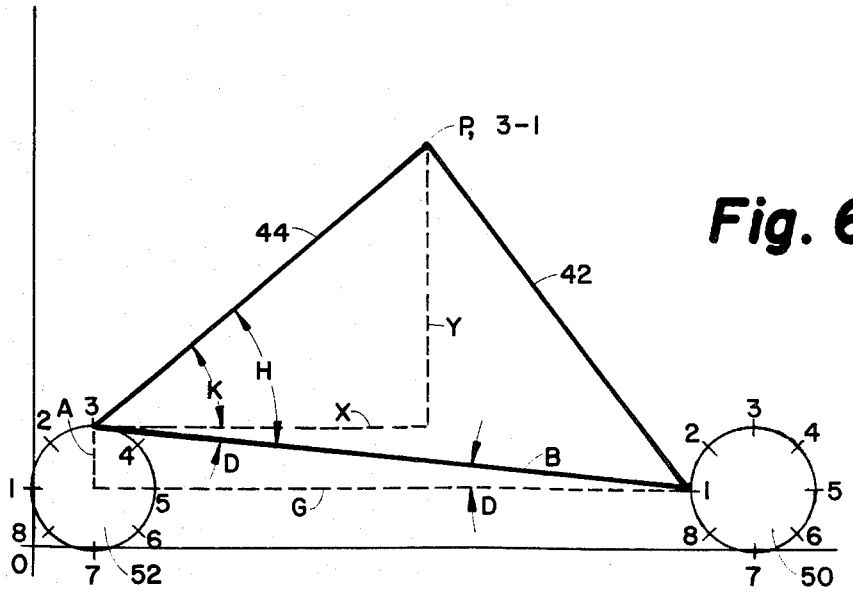
Figure 7:
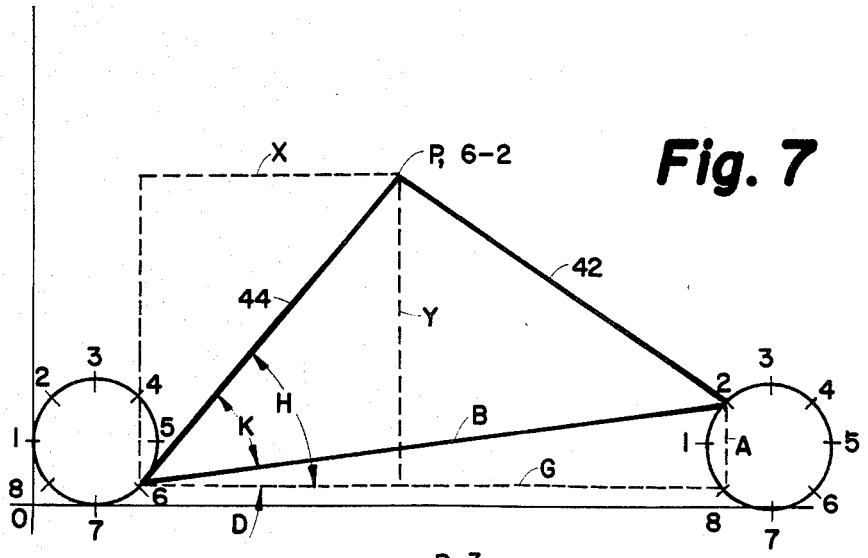

The method of the invention and operation of the particular embodiment of FIG. 1 will be further understood by now considering FIGS. 5–7.

In FIG. 5, the FIG. 1 apparatus is shown schematically with links 44 and 42 interconnected at point P1-1 and extending respectively to discs 52 and 50. Nodes 1–8 are shown for each disc. For reference purposes, the nine o'clock node of disc 52 will be called 52-1, the twelve o'clock node of disc 50 will be called 50-3, etc. In FIG. 5, the links thus have disc nodes 52-1 and 50-1, an in-phase situation. A base line B is drawn between these nodes, resulting in an isoceles triangle 44-42-B. Since the x and y coordinates relative to origin O of the all nodes are known whether by measurement or by calculation (covered below in connection with FIG. 8), B is equal to the x difference between nodes 50-1 and 52-1. Angle D of the triangle is determinable, since cosine $H = B/2L$ from the law of cosines, where L is the length of each of links 42 and 44. One now can determine the x and y coordinates of point P1-1 relative to node 52-1 since X is equal to L times the cosine of H and Y is equal to L times the sine of H. The coordinates of P1-1 relative to origin O are obtained by adding the x and y coordinates of node 52-1 to X and Y, respectively.

From the foregoing, one can determine all coordinates of apex points for in-phase disposition of discs 52 and 50. The locus of such apex points in such in-phase disposition is a circle.

As discs 52 and 50 rotate out-of-phase, the analysis of FIG. 5 applies only to such situations in which base line B is horizontally disposed, i.e., the respective link-connected nodes of the discs are at identical y-axis locations. On the other hand, only two other dispositions exist for the base line. It will tilt (and translate) either clockwise or counterclockwise from the horizontal.

FIG. 6 illustrates a clockwise tilt from horizontal wherein link 44 is at node 52-3 and link 42 is at node 50-01. The angle of tilt is D and this same angle exists as D′ in the triangle AGB. A is known as it is the y-difference between nodes 52-3 and 50-1. G is known as it is the difference in x between these nodes. Angle D′ is now determinable as the arc tangent of A/G. B can now be determined as it is equal to G/cosine D′. Given B, the cosine of angle H is B/2L. Angle K is equal to H−D, and defines with L the x and y coordinates of point P3-1 relative to node 52-3, i.e., x equals L times the cosine of K and Y equals L times the sine of K. By adding the x and y coordinates of node 52-3 to X and Y, one obtains the x and y coordinates of P3-1 relative to origin O.

Referring to FIG. 7, a counterclockwise tilt is shown wherein link 44 is at node 52-6 and link 42 is at node 50-2. Angle D is the arc tangent of A/G, A and G being known from the coordinates of nodes 52-6 and 50-2. B is now G/cosine D and H becomes determinable as its cosine is B/2L. Angle K is now the sum of angles H and D. X and Y are determinable as L cosine K and L sine K, respectively. The coordinates of P6-2 are derived from X, Y and the x, y coordinates for node 52-6.

As will now be seen, the baselines B of the triangles created by links 42 and 44 are of varying lengths, varying locations and varying inclinations in the course of rotation, dependently upon the relative phase differences which come to exist as the discs rotate. Such lengths, locations and inclinations, as developed above, ultimately depend upon and are fully prescribed by the positional coordinates of the ends of the links connected to links 42 and 44. Such coordinates are cumulatively defined by the locus of each of these link ends. In the illustrated embodiment, each such locus is a circle of commom radius, the rotational speed of one slightly exceeding that of the other. Alternatively, the loci may be of different radii with the discs rotated at slightly different speeds.

In broad view, the method of the invention thus contemplates the storage of sets of positional coordinates, e.g., nodes 52-1 through 52-8 being one set and nodes 50-1 through 50-8 being the other set. In phased rotation, the values of the respective sets are used in correspondence. In out-of-phase rotation, the values of the respective sets are used non-correspondingly. The loci of the patterns being generated are derived by combining the positional inputs of such corresponding and non-corresponding positional coordinate values, which may be considered as displacement forces or vectors.

The value set storage and value selection processes inherent in the illustrated structure and the obtainance of the patterns illustrated in FIG. 4 are seen from the following exemplary program implementing the computations for FIGS. 5–7. The program is written in Basic language and the running thereof on such as TRS-80 microcomputer system available from Tandy Corporation will provide a printout of coordinates defining the patterns of FIG. 4.

For reference purposes, a radius of one unit is selected for each disc, a length (L) for the links is selected as twelve units, and the length of the baseline (B) in its FIG. 5 disposition is set at twenty units. Discussion will follow the program after its presentation.

```
10 REM *LENS SURFACING PROGRAM*
20 Z=.0174539
30 L=12:R=0
40 DIM E(400):DIM EE(400):DIM F(400):DIM FF(400)
50 DATA 0,.019,.076,.168,.293,.444,.617,.804,1
55 DATA 1.195,1.383,1.556,1.707,1.831,1.924,1.981,2
60 DATA 1.981,1.924,1.831,1.707,1.556,1.383,1.195,1
65 DATA .804,.617,.444,.293,.168,.076,.019
70 DATA 1,1.195,1.383,1.556,1.707,1.831,1.924,1.981,2
75 DATA 1.981,1.924,1.831,1.707,1.556,1.383,1.195,1
80 DATA .804,.617,.444,.293,.168,.076,.019
85 DATA 0,.019,.076,.168,.293,.444,.617,.804
90 DATA
20,20.019,20.076,20.168,20.293,20.444,20.617,20.804,21
95 DATA
21.195,21.383,21.556,21.707,21.831,21.924,21.981,22
100 DATA
21.981,21.924,21.831,21.707,21.556,21.383,21.195,21
105 DATA 20.804,20.617,20.444,20.293,20.168,20.076,20.019
110 DATA 1,1.195,1.383,1.556,1.707,1.831,1.924,1.981,2
115 DATA 1.981,1.924,1.831,1.707,1.556,1.383,1.195,1
120 DATA .804,.617,.444,.293,.168,.076,.019
125 DATA 0,.019,.076,.168,.293,.444,.617,.804
130 FOR S=1 TO 32: READ E(S):NEXT S
140 FOR S=1 TO 32: READ F(S):NEXT S
150 FOR S=1 TO 32: READ EE(S):NEXT S
160 FOR S=1 TO 32: READ FF(S):NEXT S
170 INPUT "WHAT IS NODE A"; P
180 INPUT "WHAT IS NODE B"; Q
190 IF F(P)>FF(Q) THEN 220 ELSE 200
200 IF F(P)<FF(Q) THEN 350 ELSE 210
210 IF F(P)=FF(Q) THEN 480 ELSE 2000
220 A=F(P)−FF(Q)
230 B= EE(Q)−E(P)
240 C= A/B
250 D=ATN(C)
260 G=B/ COS(D)
270 V= G/(2*L)
275 H= −ATN(V/SQR(−V*V +1)) +1.5708
300 K=H−D
305 W= COS(K)
310 X=E(P)+(L*W)
315 T= SIN(K)
320 Y=F(P)+(L*T)
325 PRINT X, Y
330 GOSUB 1000
340 GOTO 190
350 A=FF(Q)−F(P)
360 B= EE(Q)−E(P)
370 C= A/B
380 D= ATN(C)
390 G=B/ COS(D)
400 V= G/(2*L)
405 H= −ATN(V/SQR(−V*V +1)) +1.5708
430 K=H+D
435 W= COS(K)
440 X=E(P)+(L*W)
445 T= SIN(K)
450 Y=F(P)+(L*T)
455 PRINT (X,Y)
460 GOSUB 1000
470 GOTO 190
480 B= EE(Q)−E(P)
490 G=B
500 V= G/(2*L)
502 H= −ATN(V/SQR(−V*V +1)) +1.5708
535 W= COS(H)
540 X=E(P)+(L*W)
545 T= SIN(H)
550 Y=F(P)+(L*T)
555 PRINT (X,Y)
```

-continued

```
560 GOSUB 1000
570 GOTO 190
1000 R=R+1: IF R=32 THEN 2000 ELSE 1005
1005 IF P=32 THEN 1030
1010 IF P<32 THEN P=P+1
1020 GOTO 1040
1030 P=1
1040 IF Q=32 THEN 1060
1050 IF Q<32 THEN Q=Q+1
1055 GOTO 1080
1060 Q=1
1080 RETURN
2000 PRINT "CYCLE COMPLETE":END
```

Following initialization and setting of constants in steps 10–40 (Z is the conversion between degrees and radians), DATA is entered in steps 50–125 and is derived trigonometrically (discussed with FIG. 8 below). For providing detail, thirty-two nodes are selected for each disc, rather than the illustrative eight in FIG. 4. Thus, steps of eleven and twenty-five hundredths degrees exist between successive nodes, as opposed to the forty-five in the FIG. 4 example. DATA steps 50, 55, 60 and 65 are one grouping (E(S) of step 130) and are the x coordinates for disc 52 of FIG. 5, starting at its nine-o'clock position and proceeding clockwise for one revolution. DATA steps 70, 75, 80 and 85 are another grouping (F(S) of step 140) and are the y coordinates for disc 52 of FIG. 5, starting at its nine-o'clock position and proceeding clockwise for one revolution. DATA steps 90, 95, 100 and 105 are another grouping (EE(S) of step 150) and are the x coordinates for disc 50 of FIG. 5, starting at its nine-o'clock position and proceeding clockwise for one revolution. DATA steps 110, 115, 120 and 125 are a final grouping (FF(S) of step 160) and are the y coordinates for disc 50 of FIG. 5, starting at its nine-o'clock position and proceeding clockwise for one revolution.

In steps 130–160, the DATA is read into the four arrays, E(S), F(S), EE(S) and FF(S), each comprising thirty-two elements. The E(S) and F(S) groupings together constitute the set of positional coordinates for disc 52 and EE(S) and FF(S) groupings constitute the set of positional coordinates for disc 50.

In step 170, input is made of any desired node for disc 52, this input being tagged as P. In step 180, input is made of any desired node for disc 50, this input being tagged as Q.

In step 190, inquiry is made of whether the y coordinate of the disc 52 node selected in step 170 exceeds the y coordinate of the disc 50 node selected in step 180, i.e., is the orientation of the triangle baseline in the FIG. 6 disposition? The converse inquiry is made in step 200, i.e., is the FIG. 7 disposition called out by the node selections? The third inquiry, i.e., is the FIG. 5 baseline orientation at hand?, is made in step 210.

The computational steps for the x and y coordinates of the triangle apex, described above in connection with discussion of FIGS. 6, 7 and 5, respectively, are set out in (a) steps 220–325, (b) steps 350–455, and (c) steps 480–555. Subroutine 1000–1060 is called out following the computation for each apex and advances the computation to the next successive nodes involved. As will be seen, the subroutine increments by one each of the P and Q node selections until a full revolution of disc 52 occurs.

If one sets P as one and progresses the Q selection stepwise from one to thirty-two in the above program and plots the resulting thirty-two printouts, there results thirty-two patterns ranging progressively from circular to ellipses having major axes extending in the X-direction and successively of decreasing minor axes, to a rectilinear trace in the X-direction, to transition patterns, to a rectilinear trace in the Y-direction, to ellipses having major axes extending in the Y-direction and successively of decreasing minor axes and returning to circular, indicative of the return to in-phase disposition of the discs.

Figure 8:
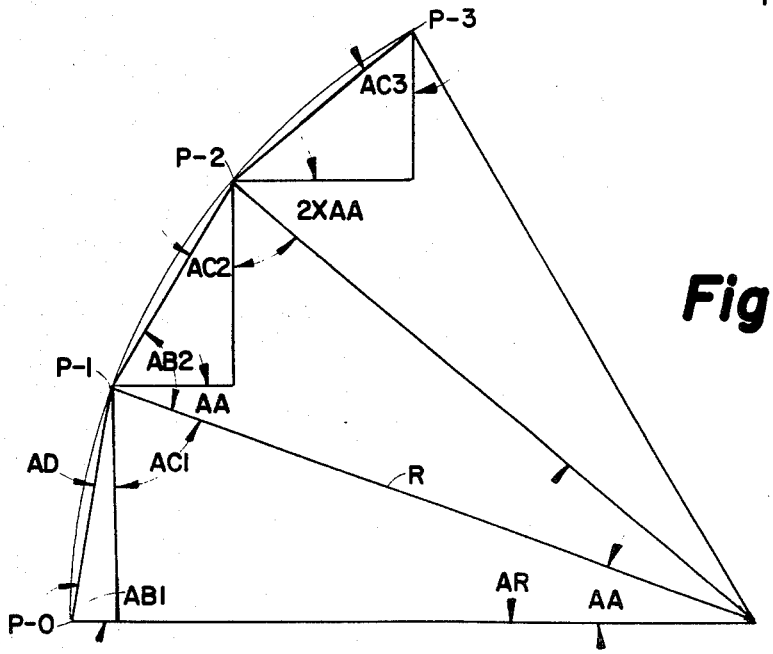
FIG. 8 is an explanatory diagram from which sets of positional coordinates for a locus may be determined.

Referring to FIG. 8, a practice for computing the foregoing DATA is shown geometrically for an exemplary locus of points P0-P1-P2-P3. The step angle, i.e., the angle between adjacent points, is AA, shown illustratively as twenty-two and one-half degrees. The circular locus has radius R. The angle AC1 will be seen to define with chord AD the x and y differences between P0 and P1, angle AC2 likewise for P2 and P1, angle AC3 likewise for P3 and P2. It will also be noted that such angle increases progressively as step angle AA is accumulated.

Angle AB1 is known as $AB1=0.5(180-AA)$. Angle AC1 shares a right triangle with angle AB1 and is known as $AC1=90-AB1$. One can accordingly find angle AC1 as AC1=0.5(AA). Angle AB2 is less than angle AB1 by angle AA as seen in FIG. 8. Since, however, the same right triangular relation applies as between AB2 and AC2, i.e., their sum is ninety degrees, $AC2=AA+0.5(AA)$. Calling the cumulative step angle AR, one will find that $AC3=AR+0.5(AA)$, where AR is now two steps, i.e., 2(AA). The following program provides full information as to the positional coordinates for a quadrant for any desired step angle integrally divisible into ninety degrees.

```
5 AX=0:AY=0
10 Z=.0174539: X=0: Y=0
20 INPUT "STEP ANGLE?";AA
25 INPUT "RADIUS";R
30 FOR S=1 TO 90/AA
35 IF S>1 THEN 90
40 AB=.5*(180-AA)
50 A= SIN(AA*Z)
60 B= SIN(AB*Z)
70 AD= R*A/B
80 AC=90-AB
90 AX=AD*SIN(AC*Z)
100 AY=AD*COS(AC*Z)
110 LPRINT AX+X,AY+Y
120 AR=S*AA
130 AC=AR+(AA/2)
140 X=X+AX:Y=Y+AY
150 NEXT S
160 PRINT "END":END
```

Values for other quadrants flow readily from the above. For the second disc, one simply increments the entire x coordinate set by the assigned baseline in the FIG. 5 disposition.

Various modifications to the particularly described apparatus and changes to the illustrated methods will be evident to those skilled in the art and may be introduced without departing from the invention. Thus, one may elect to displace, in the constantly changing endless trace continuous patterns of FIG. 4, either the surfacing tool or the optical element being worked. The other of the surfacing tool and optical element may be oscillated, as shown in FIG. 1. As noted, the tool and optical element are maintained in engagement through a slurry or other medium throughout pattern generation and surfacing. The particularly described apparatus and methods are thus intended in an illustrative and not in a limiting sense. The true spirit and scope of the invention is set forth in the following claims.

We claim:

1. A method for surfacing an optical member, comprising the steps of:
   (a) securing said optical member;
   (b) diposing a surfacing tool in engagement with said optical member; and
   (c) while maintaining such engagement between said optical member and said surfacing tool, displacing said surfacing tool progressively in a first circular pattern, in a first rectilinear pattern along an optical axis of said optical member and in a second circular pattern.

2. The method claimed in claim 1 wherein said step (c) is further practiced by displacing said surfacing tool in a first eliptical pattern having its major axis extending in the direction of said first rectilinear pattern following displacement of said surfacing tool in said first circular pattern and prior to displacement of said surfacing tool in said first rectilinear pattern.

3. The method claimed in claim 1 wherein said step (c) is further practiced by displacing said surfacing tool in a second rectilinear pattern orientated differently from said first rectilinear pattern following displacement of said surfacing tool in said first rectilinear pattern and prior to displacement of said surfacing tool in said second circular pattern.

4. The method claimed in claim 2 wherein said step (c) is further practiced by displacing said surfacing tool in a second elliptical pattern orientated differently from said first elliptical pattern following displacement of said surfacing tool in said first rectilinear pattern and prior to displacement of said surfacing tool in said second circular pattern.

5. The method claimed in claim 4 wherein said step (c) is further practiced by displacing said surfacing tool in a second rectilinear pattern orientated differently from said first rectilinear pattern following displacement of said surfacing tool in said first rectilinear pattern and prior to displacement of said surfacing tool in said second elliptical pattern.

6. The method claimed in claim 5 wherein said second elliptical pattern has its major axis extending in the direction of said second rectilinear pattern.

7. The method claimed in claim 1 including the further step of displacing said optical member in preselected pattern during practice of said step (c).

8. The method claimed in claim 7 wherein said preselected pattern for displacement of said optical member is an oscillatory pattern.

9. The method claimed in claim 1 wherein said step (c) is practiced in part by selecting and storing first and second sets of displacement forces, each set having a corresponding number of elements, and by displacing said surfacing tool selectively in accordance with the displacement forces of non-corresponding elements of said sets.

10. A method for generating patterns comprising the steps of:
   (a) selecting and storing first and second sets of positional coordinates, each set having a corresponding number of elements;
   (b) supporting a pattern generating member for movement about first and second different axes; and
   (c) displacing said member selectively in accordance with the positional coordinates of non-corresponding elements of said sets to effect the generation successively of differently shaped patterns.

11. The method claimed in claim 10 wherein said steps (b) and (c) are practiced to effect the generation successively of patterns inclusive of elipses having major axes orientated respectively along different axes.

12. The method claimed in claim 10 wherein said steps (b) and (c) are practiced to effect the generation successively of patterns inclusive of an ellipse having its major axis along a given axis, a trace substantially along said given axis and an ellipse having its major axis along an axis orthogonal to said given axis.

13. The method claimed in claim 10 wherein said step (b) is practiced by supporting said member for rotative movement about said first and second axes and wherein said first and second axes are mutually orthogonal axes.

14. The method claimed in claim 13 wherein said steps (b) and (c) are practiced to effect the generation successively of patterns inclusive of respective first and second ellipses having major axes orientated respectively along said first and second axes.

15. The method claimed in claim 13 wherein said steps (b) and (c) are practiced to effect the generation successively of patterns inclusive of an ellipse having its major axis along said first axis, a trace substantially along said first axis and an ellipse having its major axis along said second axis.

16. The method claimed in claim 13 wherein said steps (b) and (c) are practiced to effect the generation successively of patterns inclusive of an ellipse having its major axis along said first axis, a trace substantially along said first axis, a trace substantially along said second axis and an ellipse having its major axis along said second axis.

17. The method claimed in claim 13 wherein said steps (b) and (c) are practiced to effect the generation successively of patterns inclusive of a plurality of differently dimensioned ellipses having their major axes along said first axis, a trace substantially along said first axis, a trace substantially along said second axis and a plurality of differently dimensioned ellipses having their major axes along said second axis.

18. The method claimed in claim 13 wherein said steps (b) and (c) are practiced further with corresponding elements of said sets to effect the generation successively of patterns inclusive of a circle, a plurality of differently dimensioned ellipses having their major axes along said first axis, a trace substantially along said first axis, a trace substantially along said second axis and a plurality of differently dimensioned ellipses, having their major axes along said second axis.

19. A method for generating patterns comprising the steps of:
   (a) mutually pivotally securing first and second rigid members with respect to one another at first locations therealong;
   (b) restricting movement of a second location of said first member to a first path locus;
   (c) restricting movement of a second location of said second member to a second path locus: and
   (d) displacing said first member second location and said second member second location to effect displacement jointly of said first locations of said first and second members in succeedingly diversely configured patterns inclusive of a rectilinear trace.

20. The method claimed in claim 19 wherein said step (c) is practiced by configuring said first path locus and said second path locus to be endless and of common length per single passage therethrough and wherein said step (d) is practiced by displacing said first member second location at a linewise speed in excess of the linewise speed of displacement of said second member second location.

21. The method claimed in claim 20 wherein such first and second path loci are circular in configuration.

22. The method claimed in claim 21 wherein such first locations of said first and second members are selected to be at ends of said first and second members.

23. The method claimed in claim 22 wherein such second locations of said first and second members are selected to be at ends opposite said first-mentioned ends thereof.

24. The method claimed in claim 19 wherein said step (c) is practiced by configuring said first path locus and said second path locus to be endless and of respective different lengths per single passage therethrough and wherein said step (d) is practiced by displacing said first member second location at a linewise speed equal to the linewise speed of displacement of said second member second location.

25. The method claimed in claim 24 wherein such first and second path loci are circular in configuration.

26. The method claimed in claim 25 wherein such first locations of said first and second members are selected to be at ends of said first and second members.

27. The method claimed in claim 26 wherein such second locations of said first and second members are selected to be at ends opposite said first-mentioned ends thereof.

* * * * *